United States Patent [19]

Fulton

[11] 4,247,217

[45] Jan. 27, 1981

[54] ROPE SWIVEL SOCKET

[76] Inventor: Mark E. Fulton, 727 Eighth St., Marietta, Ohio 45750

[21] Appl. No.: 52,863

[22] Filed: Jun. 28, 1979

[51] Int. Cl.[3] ..... F16D 1/12; F16D 3/00; B25G 3/02

[52] U.S. Cl. ..... 403/164; 403/165; 403/331; 403/360

[58] Field of Search ..... 403/164, 165, 331, 360

[56] References Cited

U.S. PATENT DOCUMENTS

| | | | |
|---|---|---|---|
| 1,191,250 | 6/1916 | Walker | 403/164 |
| 1,192,252 | 7/1916 | Wilt | 403/165 |
| 2,219,151 | 10/1940 | Osmun | 403/360 |
| 2,995,791 | 8/1961 | Clegg | 403/360 |

*Primary Examiner*—James Kee Chi
*Attorney, Agent, or Firm*—D. Paul Weaver

[57] ABSTRACT

A side opening rope swivel socket assembly for connecting various tools to a drilling cable in wells allows an operator to quickly and conveniently change from one tool to another, for example, from a swabbing tool for tubing to a swabbing tool for casing, without the necessity for cutting and resetting the sand line or cable for each such operation. To avoid interfering with fishing tool operations and to avoid damaging the locking nut of the socket assembly at these times, the locking nut is placed well below the wickers of the swivel or mandrel and is enlarged in diameter sufficiently to pass over the swivel when it is desired to use the swivel alone. A great savings of time is effected in change-over operations in comparison to the prior art.

3 Claims, 4 Drawing Figures

ROPE SWIVEL SOCKET

BACKGROUND OF THE INVENTION

Rope swivel sockets for detachably connecting cables to various tools in wells are well known in the prior art. One such prior art device is disclosed in U.S. Pat. No. 2,995,791, issued to Clegg. This patent discloses a side opening socket body, a slide for the closing of the side opening, a cable attached mandrel or swivel, and a top locking nut which engages screw-threads on the upper reduced terminals of the socket body and slide. Immediately below the locking nut and above an enlarged tapered shoulder on the socket body, the Clegg device includes a fishing neck having wickers formed thereon to be engaged by a fishing tool or grapple.

The placement of the locking nut above the wickers in the Clegg device presents problems. The nut is frequently damaged during fishing operations and the nut can also interfere with the fishing equipment. Also, the small diameter locking nut at the top of the Clegg socket assembly is too small to pass over the swivel when it is desired to use the swivel alone and without the socket body with smaller size tools. Consequently, with the Clegg device, when such tool changes are necessary, the cable attached to the swivel must be cut to allow separation of the nut therefrom, and then the cable must be rebabbitted inside of the swivel or mandrel. Such operations are time-consuming and costly, sometimes requiring up to three hours.

In view of the above, the present invention has for its object to significantly improve on the convenience and utility of the prior art, and in particular, to improve on the rope swivel socket arrangement in the above-referenced Clegg U.S. Pat. No. 2,995,791. More particularly, by means of the present invention, the necessity for severing the drilling cable as required in the Clegg structure is eliminated, and the damaging of the locking nut during fishing operations and the interference of the nut with fishing tools is completely eliminated. These very important improvements are achieved in the invention by a simple relocation of the assembly locking nut to a lower elevation on the assembly well below the fishing neck and the wickers, and by increasing the size of the locking nut so that it can pass over the swivel when it is desired to separate the swivel from the socket body and use the swivel alone with an appropriate tool.

Other features and advantages of the invention will become apparent during the course of the following detailed description.

The following additional known U.S. patents are also made of record herein under the provisions of 37 CFR 1.56 and none of these patents shows or suggests the above -discussed improvements: U.S. Pat. Nos. 1,432,117; 1,453,138; 1,547,195; 1,617,664; 2,123,783; 2,152,233; 2,483,944.

DETAILED DESCRIPTION

Figure 1:
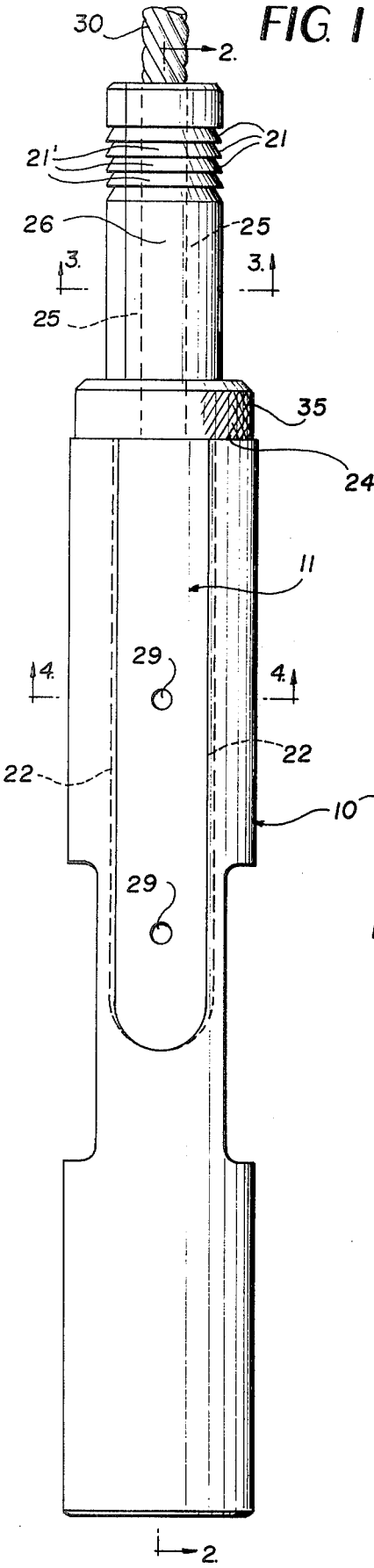
FIG. 1 is a side elevational view of a rope swivel socket assembly in accordance with the invention.

Referring to the drawings in detail, wherein like numerals designate like parts, the rope swivel assembly embodying the present invention comprises a cylindrical socket body 10, a closure slide 11, and a mandrel or swivel 12, generally in accordance with the teachings of the prior art. The socket body 10 has a longitudinal bore 13 adapted to receive the swivel 12 through a side opening 14 of the socket body, which side opening extends through the top of the socket body and terminates at 15 well below the longitudinal center of the assembly. At its lower end and below the side opening, the socket body 10 has a conventionally screw-threaded opening 16 for the attachment of larger tools, such as a casing swab or for attachment to a drill string in some applications of the invention. The socket body also has fluid relief ports 17 in its side wall portion away from the side opening 14.

The socket body has a reduced diameter screw-threaded shoulder 18 at a point near the top of the swivel 12 in the assembly and a further reduced diameter coaxial extension 19 on the top of the socket body terminates in a fishing neck 20 having wickers 21 formed thereon to coact with a conventional fishing tool or grapple.

The slide 11, which is of one-piece construction, has flanges 22 on opposite sides thereof which are slidably engaged in longitudinal containment grooves 23 of socket body 11, such grooves running downwardly from the elevation of an annular flat lock nut seating ledge 24 on the socket body. The outer surface of the one-piece slide 11 is formed on an arc to match the cylindrical curvature of the socket body, both at its lower larger diameter portion as well as the reduced diameter portion or extension 19. Such extension 19 of the socket body has flat faces 25, FIG. 3, on opposite sides of opening 14 for the seating of the upper inset extension 26 of the slide 11. The slide 11 is screw-threaded at 27 to match the threads 18 of the socket body and provide circumferentially continuous threads on the assembly at this point. The slide has an external flat shoulder surface 28 at the same elevation as the ledge 24 on the socket body. The slide also has fluid relief ports 29, as shown.

The swivel 12 is attached to a drilling cable 30 which is secured within a bore 31 of the swivel by babbitting in a known manner. The upper neck portion 32 of the swivel 12 also has wickers 33 thereon. At its lower end, the swivel 12 is internally screw-threaded as at 34 for attachment to certain tools, such as tubing swab tools and others of a smaller nature than those attached to the screw-threads 16 of the socket body. The general mode of use of the rope swivel socket assembly in wells is well-known in the art and need not be further described.

A knurled locking nut 35 completes the assembly in accordance with the invention and this nut serves to firmly lock the slide 11 in assembled relationship with the socket body 10 so that the swivel or mandrel 12 is removably held inside of the bore 13 but can be removed when necessary through the side opening 14 of the socket body. The location and diameter of the locking nut 35 are key features of the invention. The nut 35 is located well below the wickers 21 so that it cannot interfere with fishing operations or be damaged by the fishing tool, as frequently occurs in the prior art. Also, the internal diameter of the nut 35 is large enough to slip over the swivel 12 when it is desired to use the swivel alone after it has been removed through the side opening of the socket body 10. As explained previously, this eliminates the necessity for cutting and rebabbitting the cable 30 in the manner frequently necessitated in the prior art where a smaller locking nut is placed at the top of the assembly above the wickers.

Figure 2:
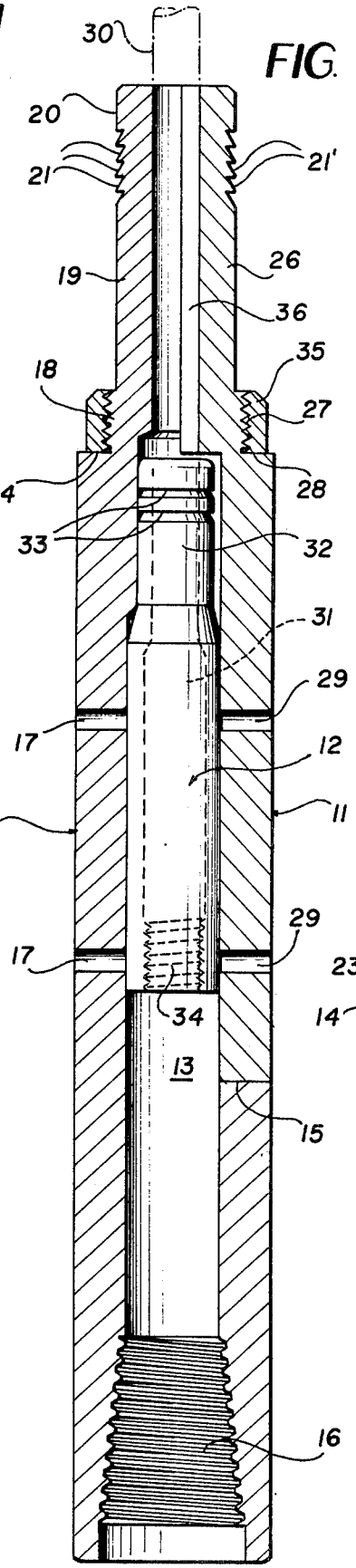
FIG. 2 is a central vertical longitudinal section taken on line 2—2 of FIG. 1.
Figure 3:
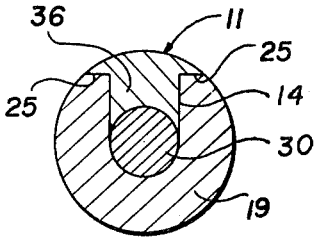
FIG. 3 is a transverse section taken on line 3—3 of FIG. 1.
Figure 4:
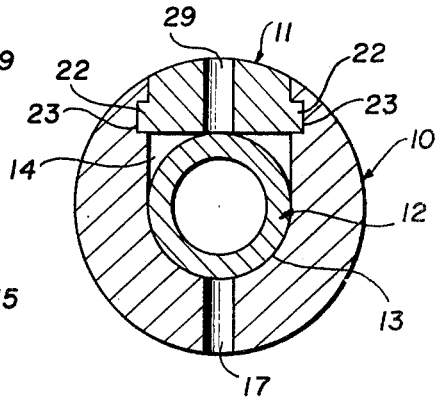
FIG. 4 is a similar section taken on line 4—4 of FIG. 1.

It should also be mentioned that the top extension 26 of slide 11 has wickers 21' to match the wickers 21 of the socket body. It should also be noted that the top portion of side opening 14 along the extension 19 is of sufficient width as shown in FIG. 3 to allow free passage therethrough of the cable 30. In this region, the slide 11 has an inset cable engaging rib or shoe 36, FIGS. 2 and 3.

The increased convenience and utility of the assembly and the valuable time saved through its usage in the described manner should now be readily apparent to those skilled in the art. These improvements or advantages are the result of relocating the locking nut 35 below the level of the wickers and increasing its size so that it may pass over the swivel or mandrel 12.

It is to be understood that the form of the invention herewith shown and described is to be taken as a preferred example of the same, and that various changes in the shape, size and arrangement of parts may be resorted to, without departing from the spirit of the invention or scope of the subjoined claimes.

I claim:

1. A rope swivel socket assembly for use in wells comprising a socket body having a side opening extending through one end thereof, the socket body including a reduced top extension having fishing wickers thereon, the reduced extension of the socket body having external screw threads at a point substantially below said wickers and the external screw threads being of a diameter exceeding the outside diameter of the wickers, the socket body having a bore, a swivel insertable in said bore through said side opening of the socket body and being attached to a cable which extends upwardly through and beyond the top end of said assembly, said swivel having an external diameter less than the diameter of said external screw threads, a slide engageable with the socket body to cover said side opening and retain the swivel in said bore and having a top reduced extension provided with wickers at the elevation of the first-named wickers and having external screw threads at the elevation of the first-named external screw threads on the socket body, and a locking nut engageable with the first-named and second-named external screw threads of the socket body and slide substantially below said wickers, the locking nut having an internal diameter of sufficient size to pass over the wickers and also to pass over the swivel.

2. A rope swivel socket assembly as defined in claim 1, and said swivel having wickers thereon adjacent to its top end.

3. A rope swivel socket assembly as defined in claim 1, and the socket body having lower end screw threads for attachment thereto of tools of one size range, and said swivel having lower end screw threads for the attachment thereto of tools of another and smaller size range.

* * * * *